US008297869B2

(12) United States Patent
Gueret

(10) Patent No.: US 8,297,869 B2
(45) Date of Patent: Oct. 30, 2012

(54) PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1331 days.

(21) Appl. No.: 11/730,516

(22) Filed: Apr. 2, 2007

(65) Prior Publication Data

US 2007/0227553 A1 Oct. 4, 2007

Related U.S. Application Data

(60) Provisional application No. 60/818,307, filed on Jul. 5, 2006.

(30) Foreign Application Priority Data

Apr. 3, 2006 (FR) ..... 06 51171

(51) Int. Cl.
*B05C 11/00* (2006.01)

(52) U.S. Cl. ..... 401/266; 401/265; 401/6

(58) Field of Classification Search ..... 401/261–266, 401/6

See application file for complete search history.

(56) References Cited

U.S. PATENT DOCUMENTS

| | | | | | |
|---|---|---|---|---|---|
| 378,743 | A | * | 2/1888 | Underwood | 401/132 |
| 2,034,137 | A | * | 3/1936 | Fitz-Gibbon | 401/266 |
| 2,897,526 | A | * | 8/1959 | Dootson | 401/266 |
| 2,921,324 | A | * | 1/1960 | Gibbons | 401/263 |
| 3,032,803 | A | | 5/1962 | Walshauser | |
| 4,002,182 | A | * | 1/1977 | Michel | 401/263 |
| D376,697 | S | * | 12/1996 | Green et al. | D4/114 |
| 5,797,692 | A | * | 8/1998 | Poole et al. | 401/266 |
| 5,988,923 | A | * | 11/1999 | Arai | 401/262 |
| 6,280,108 | B1 | | 8/2001 | Haining et al. | |
| 6,390,709 | B1 | * | 5/2002 | Zerebecki et al. | 401/193 |
| 6,464,115 | B2 | * | 10/2002 | Wemyss et al. | 222/567 |
| 6,533,484 | B1 | * | 3/2003 | Osei et al. | 401/205 |
| 6,592,282 | B2 | * | 7/2003 | Fontanet et al. | 401/266 |
| 6,688,317 | B2 | | 2/2004 | Gueret | |
| 6,715,951 | B2 | | 4/2004 | Gueret | |
| 6,745,781 | B2 | * | 6/2004 | Gueret | 132/320 |
| 6,866,437 | B2 | | 3/2005 | Gueret | |
| 7,134,799 | B2 | | 11/2006 | Gueret | |
| 2007/0017544 | A1 | | 1/2007 | Gueret | |

FOREIGN PATENT DOCUMENTS

| | | | |
|---|---|---|---|
| EP | 1 169 939 | A1 | 1/2002 |
| EP | 1 440 629 | A1 | 7/2004 |
| EP | 1 745 717 | A2 | 1/2007 |
| FR | 2 805 720 | | 9/2001 |
| WO | WO 02/085733 | A2 | 10/2002 |
| WO | WO 2006/049283 | A1 | 5/2006 |

OTHER PUBLICATIONS

European Search Report dated Dec. 10, 2010 in corresponding European Application No. 07 300 917.7 (with translation).

* cited by examiner

*Primary Examiner* — David Walczak
(74) *Attorney, Agent, or Firm* — Oliff & Berridge, PLC

(57) ABSTRACT

A packaging and applicator device for applying at least one cosmetic composition, the device including: a reservoir containing the composition to be dispensed; an applicator head that is secured to the reservoir at least during application, the head presenting an application face for coming into contact with the region to be treated, and including at least one cavity that opens out into the application face; and at least one feed channel for supplying composition to the application face; the applicator head including at least one portion that is cantilevered-out as far as the periphery of the applicator head, and that defines the application face at least in part.

42 Claims, 5 Drawing Sheets

FIG.1
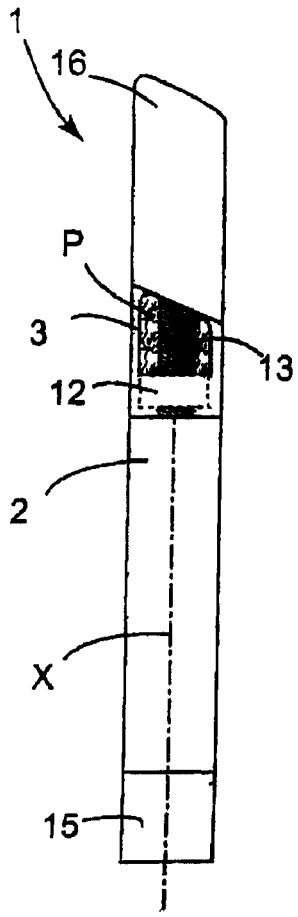
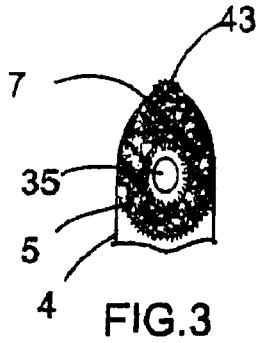
FIG.3
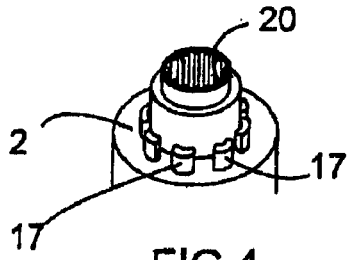
FIG.4
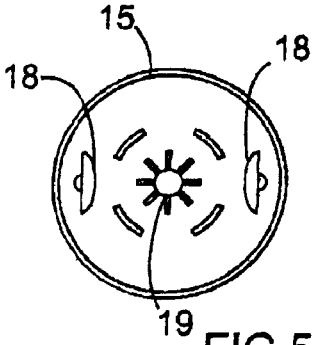
FIG.5
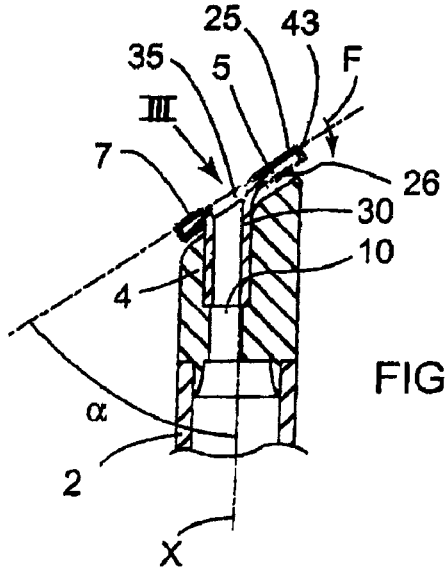
FIG.2

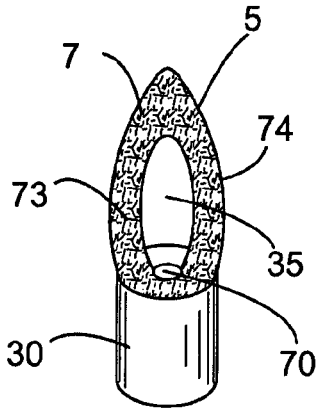
FIG.19
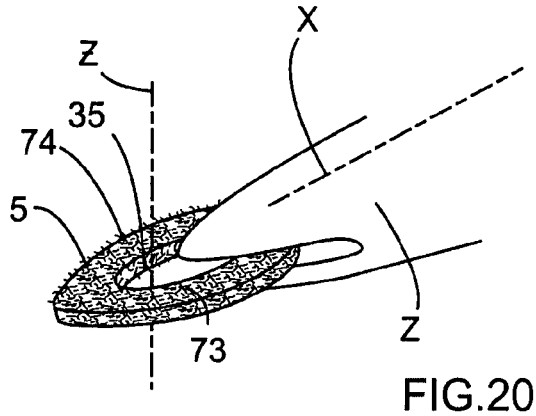
FIG.20
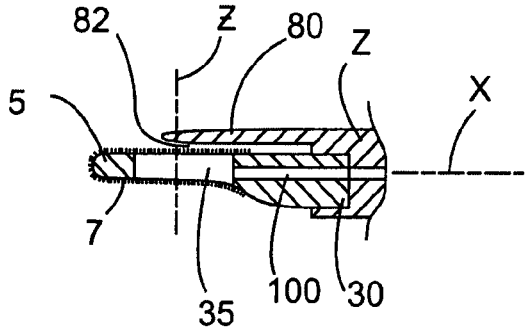
FIG.21
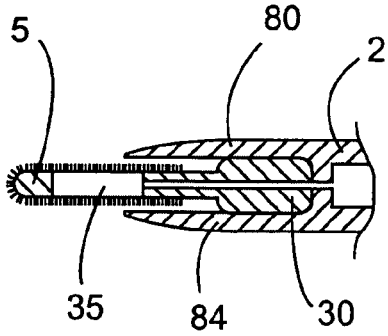
FIG.22
FIG.23
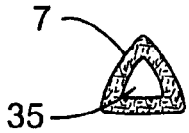
FIG.24
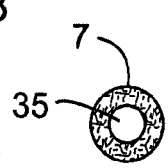
FIG.25
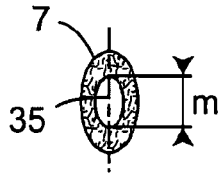
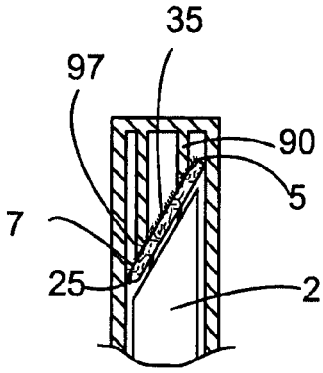
FIG.28
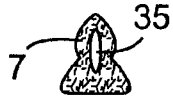
FIG.27
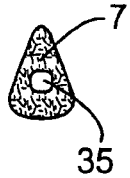
FIG.26

PACKAGING AND APPLICATOR DEVICE

This non provisional application claims the benefit of French Application No. 06 51171 filed on Apr. 3, 2006 and U.S. Provisional Application No. 60/818,307 filed on Jul. 5, 2006.

The present invention relates to packaging and applicator devices comprising a reservoir containing at least one composition to be dispensed, and an applicator element that is secured to the reservoir at least during application.

BACKGROUND OF THE INVENTION

U.S. Pat. No. 6,745,781 describes a device of that type, in which the applicator element includes a flocked mesh.

U.S. Pat. No. 6,688,317 describes a device in which the applicator element includes a groove that makes it possible to collect excess composition that is present on the application face.

In addition, international application WO 02/085733 discloses a device including a support and a compressible applicator element that is mounted in stationary manner on a face of the support. An annular groove is formed between the support and the face of the applicator element that faces said support, so as to impart increased flexibility to the peripheral region of the applicator element.

Known devices for applying makeup to the lips are not entirely satisfactory.

In particular, during application, the composition can accumulate on the periphery of the applicator element, which can lead to makeup not being applied as uniformly as desired, in particular with highly colored compositions having an appearance that is very dependent on the quality of the deposit formed on the lips.

OBJECTS AND SUMMARY OF THE INVENTION

Consequently, there exists a need to improve still further packaging and applicator devices, in particular so as to apply makeup to the skin or the lips in a more uniform manner.

There also exists a need to increase comfort in applying makeup, in particular to the lips.

The invention seeks to satisfy all or some of those needs.

It achieves this by means of a packaging and applicator device for applying at least one cosmetic composition, including a care product, the device comprising:

- a reservoir containing the composition to be dispensed;
- an applicator element including an applicator head that is secured to the reservoir at least during application, the head presenting an application face for coming into contact with the region to be treated, and including a cavity that opens out into the application face; and
- at least one feed channel for supplying the application face with composition coming from the reservoir;

the applicator head including:

- at least one portion that is cantilevered-out as far as the periphery of the applicator head, and that defines the application face at least in part.

By means of the presence of the cavity and of the cantilevered-out portion, the applicator head presents both flexibility and capacity to change, in relatively even manner, the region to which composition is to be applied. The cavity makes it possible to build up a supply of composition, and it can also serve to collect the composition. The cavity makes it possible to smooth out the layer of composition deposited during application.

The cantilevered-out portion may be obtained by a flexible portion of the applicator head and by the reservoir being configured in such a manner that the flexibility of said flexible portion makes it possible to change the orientation of at least a portion of the application face when said application face is subjected to stress, in particular when it is brought manually against a surface to be made-up, in particular the lips.

The flexible portion may advantageously be formed in the proximity of the reservoir, set back from a free distal end of the application face.

The portion of the application face of orientation that may be changed may be disposed facing a part of the reservoir that presents a step or a slope that, when said portion is at rest, is less than the slope of said portion relative to the longitudinal axis of the reservoir.

The cavity may be distinct from a capillary slot, having a diameter lying in the range 1 millimeter (mm) to 5 mm, for example, and preferably of about 3 mm.

The cavity may be oval.

In particular, the applicator head may make it possible to deposit a plurality of layers of composition, so as to increase the glossiness of the lips, for example.

The applicator head may optionally be flocked.

When the applicator head is flocked, the flocking may advantageously be made with bristles of length that is greater than 1 mm, e.g. a length of 1.2 mm, such that the ends of the flocking bristles define a plane that is distinct from a plane in which the cavity is defined.

When the applicator head is flocked, the bristles may be substantially identical, or different and mixed.

The cantilevered-out portion may advantageously be flexible.

The cantilevered-out portion may define the entire periphery of the application face.

The applicator element may include a thin zone at the base of the cantilevered-out portion, thereby enabling said portion to flex more easily.

The applicator element may include a fastening endpiece for fastening to the reservoir, the endpiece possibly having the feed channel passing therethrough. The endpiece may optionally be relatively rigid, possibly being made in such a manner as to enable the applicator head to pivot about at least one axis, or even about at least two axes that are perpendicular to each other. The applicator element may be molded from at least two materials, one rigid and the other flexible. By way of example, the endpiece may be molded from the flexible material.

In an embodiment of the invention, the cavity may be a through-cavity, and the feed channel may open out into the cavity.

The cavity, that may enable a supply of composition to be accumulated, may be fed with composition via its end remote from the application face, or, in a variant, it may be fed with composition via a side orifice.

The cavity may advantageously not be centered relative to the application face.

The reservoir may include at least one extension that covers the applicator element at least in part.

A gap may be formed between the applicator element and the extension, said extension being substantially in contact with possible flocking of the applicator element, for example.

Where appropriate, the extension may cover the cavity at least in part.

The application face may present a tapering shape, in particular an upwardly-tapering shape. This may improve accuracy in applying makeup, in particular in applying makeup to the top lip.

The application face may present a pear-shaped outline.

The application face may be generally plane, or concave, or convex.

The application face may extend all around the axis of the reservoir.

When at rest, the application face may lie in a plane. Said plane may be oriented obliquely relative to the reservoir, the acute angle formed between the longitudinal axis of the reservoir and the application face lying in the range 10° to 90°, for example, preferably in the range 25° to 65°, and better in the range 35° to 40°.

The reservoir may include a flexible wall. The reservoir may also include a rigid cylindrical wall in which a piston may slide.

The composition may also be contained in a flexible pouch, with dispensing being performed without ingress of air.

The above-mentioned endpiece may be centered or off-center relative to the applicator head.

The application face may extend generally obliquely relative to a longitudinal axis of the reservoir.

The applicator element, with the exception of any possible flocking, may be made as a single part by molding an elastomer material.

By way of example, the applicator head may be made of: silicone; nitrile rubber; ethylene-propylene terpolymer rubber (EPDM); polyurethane (PU); butyl rubber; latex; thermoplastic elastomer; styrene; ethylene; polyvinyl chloride (PVC); polyurethane (PU); ethyl vinyl acetate (EVA); ethylene-propylene terpolymer rubber (EPDM); etc.; styrene-ethylene-butylene-styrene (SEBS); or one of the elastomers known under the trade names CARIFLEX, SANTOPRENE, HYTREL, PEBAX (polyether block amide).

The applicator head may present magnetic properties, e.g. so as to impart a particular orientation to magnetic particles that are contained in the composition, or so as to change at least one property of the composition.

The cavity may open out into the application face via an opening that is of greater section than the opening of an orifice of the reservoir via which the composition contained in the reservoir reaches the cavity.

The reservoir may contain a composition for making-up the lips.

The composition contained in the reservoir may be a paste or a gel, e.g. having viscosity such that it does not flow by capillarity when the device in which it is contained is head down.

The device may include a closure member having a closure pin that is disposed in such a manner as to close an outlet orifice through which the composition is dispensed onto the application face.

By way of example, the pin is arranged to be engaged in the feed channel so as to close it, or it is arranged to bear against the applicator head all around the composition outlet orifice. The outlet orifice may present a greatest dimension that is greater than or equal to 2 mm, and said outlet orifice may be of any shape, in particular oval shaped.

The inside section of the outlet orifice may present a greatest dimension, in particular a diameter, that is less than 5 mm, for example.

BRIEF DESCRIPTION OF THE DRAWINGS

The invention can be better understood on reading the following detailed description of non-limiting embodiments thereof, and on examining the accompanying drawings, in which:

FIG. 1 is a diagrammatic elevation view of an example of a packaging and applicator device of the invention;

FIG. 2 is a fragmentary longitudinal section of the FIG. 1 device;

FIG. 3 is a diagrammatic view as seen looking along arrow III of FIG. 2;

FIG. 4 is a diagrammatic perspective view of the bottom end of the FIG. 1 reservoir body, with the piston control button removed;

FIG. 5 is a plan view of the piston control button;

FIGS. 19 and 20 are fragmentary perspective views of other examples of an applicator head;

FIGS. 21 and 22 are diagrammatic and fragmentary longitudinal sections of variant embodiments of the device;

FIGS. 23 to 27 are front views of the applicator head, constituting other variant embodiments;

FIG. 28 is a fragmentary longitudinal section of a closure member; and

MORE DETAILED DESCRIPTION

Figure 6:
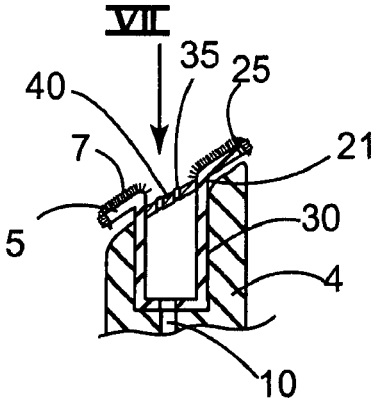
FIG. 6 is a view similar to FIG. 2, showing a variant embodiment.

The packaging and applicator device 1 shown in FIGS. 1 to 5 includes a reservoir 2, of longitudinal axis X, containing the composition P for application, and possibly having a transparent portion 3 enabling the user to see the composition P.

By way of example, the composition P is a paste or a gel, having viscosity such that it does not flow by capillarity when the device 1 is head down.

The top portion of the reservoir 2 can comprise a support 4 for an applicator element including an applicator head 5 defining an application face 7 for coming, at least in part, into contact with the region to be treated.

At least one feed channel 10 for supplying composition to the application face 7 passes through the support 4. The composition P may be forced to flow through the feed channel 10 by means of a piston 12 that is in screw engagement on a threaded rod 13, and that can move in translation in the reservoir 2 while the threaded rod 13 is being turned by means of a control button 15 situated in the bottom portion of the reservoir.

The reservoir 2 can present a tubular body of cross-section that is not circular, e.g. oval.

When not in use, the applicator head 5 may can be protected by a closure cap 16 that may be fastened on the reservoir 2.

In the embodiment under consideration, the application face 7 extends obliquely, being generally inclined, when at rest, by an angle $\alpha$ relative to the longitudinal axis X of the reservoir 2, the angle $\alpha$ lying in the range 10° to 90°, for example, preferably in the range 25° to 65°, and still better in the range 35° to 40°.

The control button 15 may be turned by increments, the bottom portion of the reservoir 2 including a plurality of tabs 17, for example, that are disposed around the rod 13, and against which there can be applied two diametrally opposite brakes 18 of the control button 15, as can be seen in FIG. 5. The control button may include a central splined cylinder 19 that is arranged to be engaged in a grooved housing 20 that is provided at the bottom end of the rod 13, so as to transmit torque between the control button 15 and the rod 13.

The applicator head 5 includes at least one cantilevered-out portion 25.

The cantilevered-out configuration of the portion 25 is obtained by a flexible portion 21 of the applicator head 5, and by the configuration of the support 4. The portion 21 presents flexibility that makes it possible, in use, to change the orientation of the portion 25 relative to the longitudinal axis X.

For example, the orientation of the portion 25 is changed when said portion is subjected to stress, e.g. by being brought manually against a surface of the body to be made-up, e.g. the lips.

In the embodiment described, the flexible portion 21 is formed in the proximity of the reservoir 2, and set back from a free distal end of the application face 7.

The portion 25 extends over the support 4, co-operating with said support to define a gap 26 enabling said portion 25 to flex, e.g. along arrow F in FIG. 2, towards the support 4.

Figure 30:
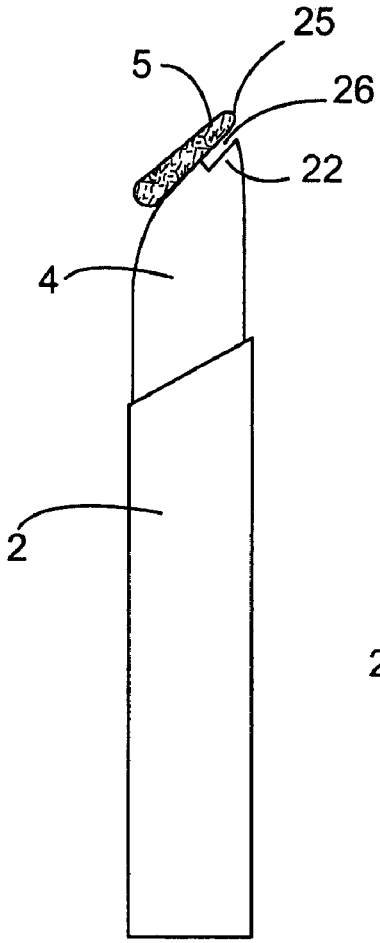

By way of example, the portion 25 extends over a part 22 of the support 4 that presents a step or a slope that, when said portion is at rest, is less than the slope of said portion 25 relative to the axis X, as shown in FIG. 30.

By way of example, the width of the gap 26 is a few tenths of a millimeter, or even a few millimeters.

The cantilevered-out portion 25 may define a fraction only of the periphery of the application face 7, or it may define the entire periphery, as shown.

The gap 26 may present an annular shape that extends all around a hollow endpiece 30 of the applicator element, said hollow endpiece serving to mount the applicator head on the reservoir 2, and communicating with the feed channel 10 for bringing the composition towards the application face 7.

The flexibility of the cantilevered-out portion 25 may be linked to the choice of material that is used to make the applicator head and/or to the presence, on said applicator head, of at least one hinge-forming zone or a zone of weakness.

The applicator head 5 may be made integrally with the endpiece 30 by molding a material, in particular an elastomer material.

The endpiece may be fastened on the reservoir 2 in various ways, e.g. by snap-fastening, by force-fitting, by screw-fastening, by adhesive, or by heat-sealing.

Where appropriate, the applicator element may be made, at least in part, with the reservoir 2, e.g. with the support 4, by injection-molding or by dual injection.

In the embodiment in FIG. 2, the endpiece 30 opens out into a cavity 35 of the applicator head 5 that is open in the application face 7.

By way of example, the cavity 35 is a single cavity and is completely surrounded by the application face 7.

By way of example, the cavity 35 extends all around the axis of the reservoir and opens out into the application face 7 permanently without any valve.

The applicator head 5 is advantageously flocked at least over the application face 7, in particular as can be seen in FIG. 3.

The applicator head 5 may also be flocked over its periphery, or even also over the bottom face of the cantilevered-out portion 25.

By way of example, the flocking is made with bristles of a length that is greater than 1 mm, e.g. equal to 1.2 mm, such that the ends of the flocking bristles define a plane that is distinct from the plane in which the cavity extends.

When the composition P is for application to the lips, in order to use the device 1, the user may turn the control button 15 in such a manner as to cause the piston 12 to rise and bring the composition P onto the application face 7 through the cavity 35.

The composition P may be spread, on the lips in particular, in relatively uniform, accurate, and comfortable manner.

Figure 7:
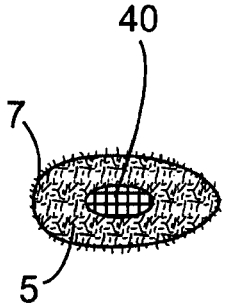
FIG. 7 is a plan view as seen looking along arrow VII of FIG. 6.

In the variant in FIGS. 6 and 7, the inside channel in the endpiece 30 opens out into the cavity 35 through a mesh 40 that may slow down the flow of composition P.

In plan view, the applicator head 5 may present a tapering shape, as can be seen in FIG. 3, with a point 43 that is situated at the top end of the application face 7, for example.

It can be seen in FIGS. 8 to 27 that various shapes may be given as much to the reservoir 2 as to the applicator element.

Figure 8:
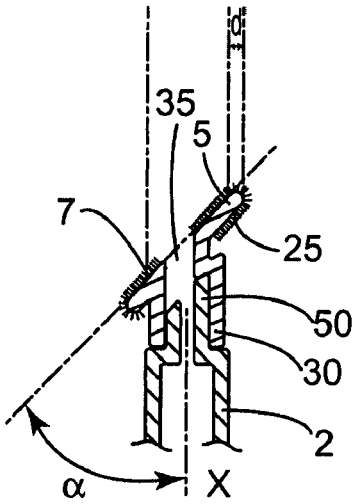

For example, as shown in FIG. 8, the reservoir 2 may include a neck 50, and the endpiece 30 may be arranged to be fastened on the outside of the neck 50.

In this figure, it can also be seen that, regardless of the way in which the applicator element is fastened on the reservoir 2, the applicator head 5 may extend laterally beyond the reservoir 2, when said reservoir is observed along the axis X, by a distance d that may be optionally constant around the axis X.

By way of example, the distance d is greater than or equal to 1 mm, indeed greater than or equal to 2 mm or 3 mm, or indeed even more.

Figure 9:
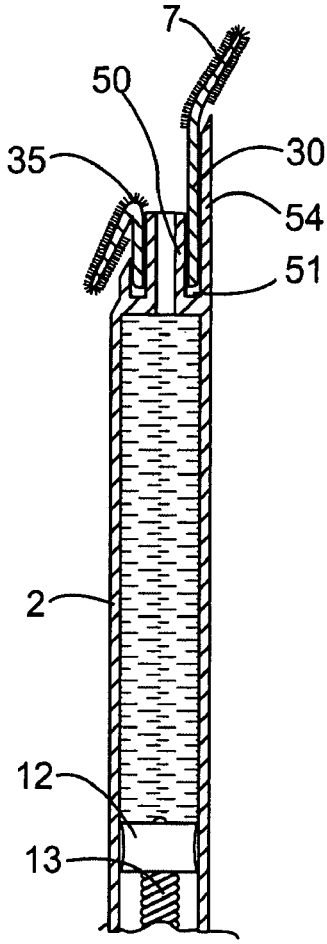
FIGS. 8 to 11, 13, 14, 16, and 17 are fragmentary longitudinal sections of variant embodiments of the applicator.

The endpiece 30 may also be engaged in an annular groove 51 of the reservoir 2, as shown in FIG. 9, the neck 50 being surrounded by an outer skirt 54 that covers the outside of the endpiece 30 at least in part, for example.

Figure 10:
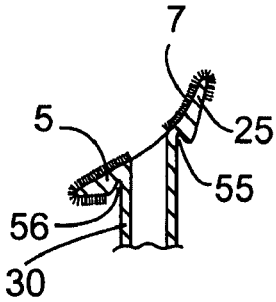

FIG. 10 shows the possibility of forming, on the applicator head 5, a hinge-forming zone 55 at the base of the cantilevered-out portion 25, so as to increase its flexibility relative to the endpiece 30.

The hinge-forming zone 55 may extend annularly around the endpiece 30, e.g. being formed by a groove 56 present on the bottom face of the applicator head 5.

Figure 11:
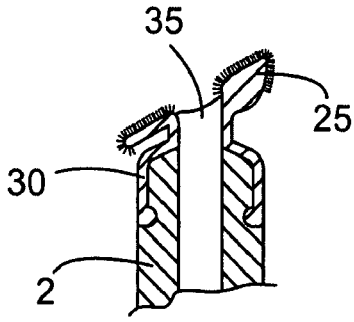

FIG. 11 shows another embodiment in which the applicator element is fastened by snap-fastening on the reservoir 2, and in which the outside surface of the endpiece 30 lies flush with the outside surface of the reservoir 2.

Figure 12:
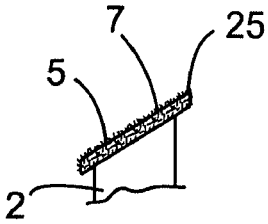
FIGS. 12 and 15 are fragmentary elevation views of variant embodiments.

Via its bottom face, and where appropriate via possible flocking, the applicator head 5 may come into contact with the reservoir 2, except for the cantilevered-out portion 25 that extends beyond the reservoir 2, as shown in FIG. 12.

Figure 13:
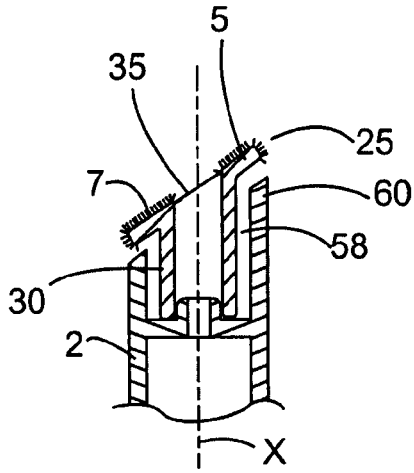

In the embodiment in FIG. 13, the periphery of the applicator head 5 hardly projects beyond the reservoir 2 when said reservoir is observed along the axis X, and the endpiece 30 is received in an annular groove 58 of the reservoir 2, which groove is radially defined by a tubular skirt 60 having a top that is situated at a certain distance from the bottom face of the cantilevered-out portion 25.

Figure 14:
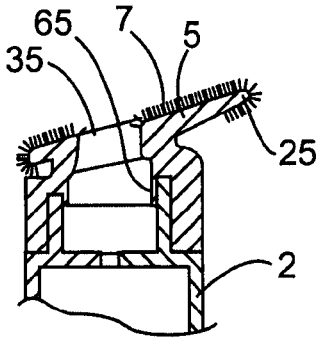

In particular, FIG. 14 shows the possibility of making the applicator element with at least one sealing lip 65 that comes to be engaged on the reservoir 2, so as to ensure that the applicator element is mounted in sealed manner on the reservoir 2.

Figure 15:
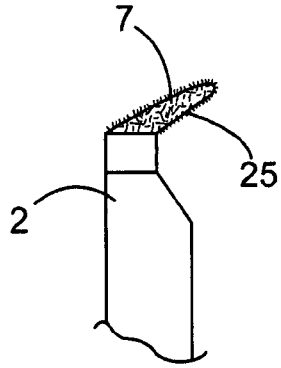

The cantilevered-out portion 25 may extend laterally on one side only of the reservoir 2, as shown in FIG. 15.

Figure 16:
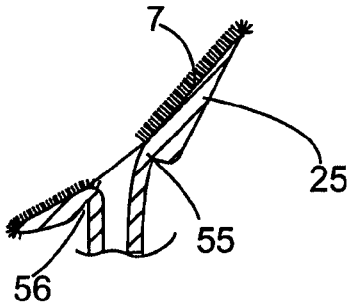

As with the applicator head in FIG. 10, FIG. 16 shows an applicator head including a zone of weakness 55, the dimensions of the cantilevered-out portion 25 nevertheless being different.

Figure 17:
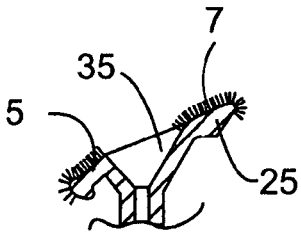

FIG. 17 shows the possibility of the cavity 35 presenting an outwardly-flaring shape, the inside of the cavity 35 possibly being flocked.

The endpiece 30 may optionally slope relative to the cantilevered-out portion 25 of the applicator head.

Figure 18:
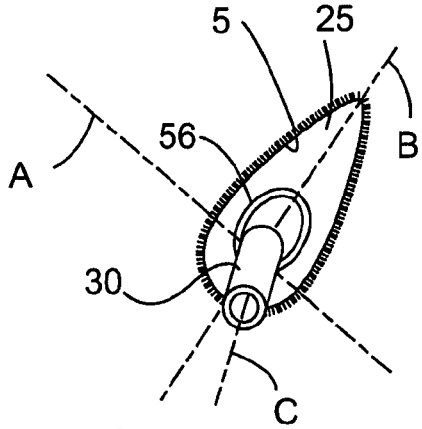
FIG. 18 is a view from below of the applicator element shown in isolation.

It can be seen in FIG. 18 that the endpiece 30 may be connected to the applicator head in a central region of said applicator head or that it may be connected off-center.

Where appropriate, and regardless of the way in which the applicator head 5 is made, the endpiece 30 may be sufficiently flexible for said applicator head to pivot about two axes A and B that are perpendicular to each other, and perpendicular to the axis C of the endpiece 30.

The cavity 35 that opens out into the application face 7 may be fed with composition via its end that is remote from the application face 7, as in the embodiments described above.

In a variant, as shown in FIG. 19, the cavity 35 may be fed via an orifice 70 that opens out laterally into the cavity 35, said cavity being a through cavity.

Such a configuration may be useful, in particular when the applicator element is mounted at the end of a reservoir with the axis Z of the cavity 35 oriented substantially perpendicularly to the longitudinal axis of the reservoir 2, as shown in FIGS. 20 and 21.

It can be seen in FIGS. 20 and 21 that the applicator head 5 may include two branches 73 and 74 that are joined together at both of their ends, and that define between them the cavity 35. The longitudinal axes of the branches 73 and 74 may extend in a plane that is parallel to the axis X, for example.

The branches 73 and 74 and/or the cavity 35 may be covered, at least in part, by an extension 80 of the reservoir 2.

The extension 80 may extend at a distance from the branches 73 and 74 that is not zero, in such a manner as to form a gap 82 relative to said branches. The gap 82 makes it possible for the applicator head 5 to flex in a direction that is substantially parallel to the axis Z.

The width of the gap 82 may correspond substantially to the height of the flocking, for example.

As in the embodiment shown, composition may arrive on the application face 7, which may be the face of the applicator head 5 that is remote from the extension 80, via a slot 100 of the endpiece 30, said endpiece serving to fasten the applicator element on the reservoir 2.

In a variant, the composition may arrive by said composition flowing over the outside of the applicator element, e.g. in a channel formed between the applicator head 5 and the extension 80, the endpiece 30 being solid for example, or even being non-existent.

In the embodiment in FIG. 22, the reservoir 2 includes two extensions 80 and 84 that are disposed on either side of the applicator head 5. The extensions 80 and 84 may optionally be symmetrical to each other about a mid-plane of the reservoir 2.

The application face 7 may present various shapes, as may the cavity 35, as can be seen in FIGS. 23 to 27.

In particular, the outline of the application face 7 may be generally triangular as shown in FIG. 23, circular as shown FIG. 24, or oblong, in particular oval, as shown in FIG. 25. The application face may present a pear-shaped outline.

The cavity 35 may present an opening, via which it opens out into the application face 7, of shape that is generally polygonal, in particular triangular or square as shown FIGS. 23 and 26 respectively, circular as shown in FIG. 24, or oblong, in particular oval, as shown FIG. 25, or even in the shape of a slot as shown in FIG. 27. The cavity 35 may define an outlet orifice through which the composition is dispensed onto the application face, said orifice having a greatest dimension m that is greater than or equal to 2 mm, and/or less than 5 mm, e.g. being equal to 3 mm.

The application face 7 may also present an outline having, when observed from above, a width that varies, e.g. passing through a minimum between its top and bottom ends, as shown in FIG. 27.

The packaging and applicator device may optionally include a removable closure member, and said closure member may include a hollow closure pin 90, for example, having a bottom end 97 that comes to bear against the application face 7 around the cavity 35, as shown in FIG. 28, so as to reduce the risk of composition flowing towards the outside of the application face 7. In a variant, the closure pin 90 may become engaged in the feed channel 10 so as to close it.

Figure 29:
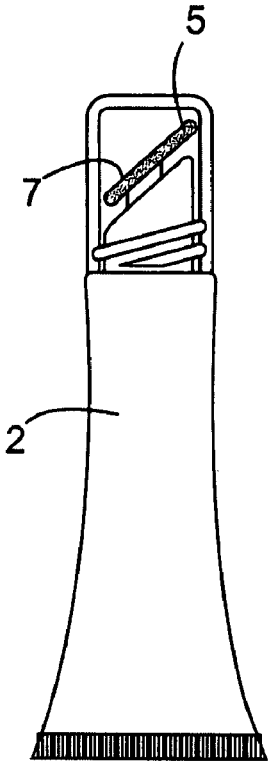
FIGS. 29 to 31 are fragmentary longitudinal sections in elevation of other variants.

The reservoir 2 may include a rigid or flexible wall, and may be in the form of a flexible tube, for example, as shown in FIG. 29. In order to dispense the composition, the user thus squeezes the wall of the tube.

Figure 31:
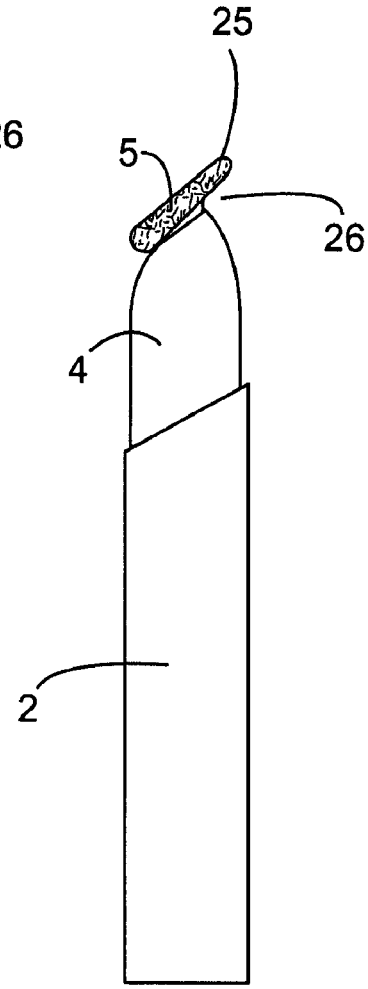

In the embodiments in FIGS. 30 and 31, it can be seen that the applicator head 5 may present a thickness that reduces towards its top end.

There can also be seen, in the embodiment in FIG. 30, the gap 26 formed with the support 4, and in FIG. 31, the cantilevered-out portion 25 that extends laterally towards the top of the support 4.

Naturally, the invention is not limited to the embodiments described above.

In particular, the applicator head could be made in many other ways.

The application face could be fed with the application face and the inside of the reservoir being in optionally permanent communication with each other.

The reservoir could be fitted with a pump or a valve, the applicator element being suitable for being secured to a control member for actuating so as to cause a measured quantity of composition to be dispensed. The control member could be contained in an airtight flexible pouch, where appropriate.

The applicator head could can be made of a material that is filled with magnetic particles, so as to present magnetic properties.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The expression "comprising a" should be understood as being synonymous with "comprising at least one", unless specified to the contrary.

What is claimed is:

1. A packaging and applicator device for applying at least one cosmetic composition, the device comprising:

a reservoir containing the composition to be dispensed;

an applicator element including an applicator head that is secured to the reservoir at least during application, the head presenting an application face for coming into contact with the region to be treated, and including at least one cavity that opens out into the application face, wherein at least one of (a) the reservoir includes at least one extension that covers, at least in part, the applicator element or (b) the application face extends generally obliquely relative to a longitudinal axis of the reservoir; and at least one feed channel for supplying the composition to the application face; the applicator head including:

at least one portion that is cantilevered-out as far as the periphery of the applicator head, and that defines the application face at least in part;

wherein the cantilevered-out portion is flexibly mounted so as to make it possible to change the orientation of at least a portion of the application face when the application face makes contact with a surface.

2. A device according to claim 1, the cantilevered-out portion defining the entire periphery of the application face.

3. A device according to claim 2, the applicator element including a thin zone at the base of the cantilevered-out portion.

4. A device according to claim 1, the applicator element including a fastening endpiece for fastening to the reservoir.

5. A device according to claim 4, the endpiece being off-center relative to the applicator head.

6. A device according to claim 4, the endpiece being flexible.

7. A device according to claim 4, the endpiece being flexible for the applicator head to pivot about two axes that are perpendicular to each other.

8. A device according to claim 4, the endpiece having the feed channel passing therethrough.

9. A device according to claim 1, the cavity being a through-cavity.

10. A device according to claim 1, the feed channel opening out into the cavity.

11. A device according to claim 10, the cavity being fed with the composition via its end remote from the application face.

12. A device according to claim 11, the application face extending around the entire axis of the reservoir.

13. A device according to claim 10, the cavity being fed with the composition via a side orifice.

14. A device according to claim 1, the reservoir includes at least one extension that covers the applicator element at least in part.

15. A device according to claim 14, a gap being formed between the applicator element and the extension.

16. A device according to claim 14, the extension covering the cavity at least in part.

17. A device according to claim 1, the application face presenting a tapering shape.

18. A device according to claim 1, the application face presenting an upwardly-tapering shape.

19. A device according to claim 1, the application face being generally plane.

20. A device according to claim 1, the reservoir including a flexible wall.

21. A device according to claim 1, the reservoir including a rigid cylindrical wall in which a piston may slide.

22. A device according to claim 1, the application face extending generally obliquely relative to a longitudinal axis of the reservoir.

23. A device according to claim 22, the longitudinal axis and the application face forming an angle, the angle lying in the range 10° to 90°.

24. A device according to claim 22, the longitudinal axis and the application face forming an acute angle, the acute angle lying in the range 25° to 65°.

25. A device according to claim 22, the longitudinal axis and the application face forming an acute angle, the acute angle lying in the range 35° to 40°.

26. A device according to claim 1, the applicator element, with the exception of any possible flocking, being made as a single part by molding an elastomer material.

27. A device according to claim 1, the applicator head presenting magnetic properties.

28. A device according to claim 1, the cavity opening out into the application face via an opening that is of greater section than the opening of an orifice of the reservoir via which the composition contained in the reservoir reaches the cavity.

29. A device according to claim 1, including a closure member for closing an outlet orifice through which the composition is dispensed onto the application face.

30. A device according to claim 1, the applicator head including a composition outlet orifice having a greatest dimension that is greater than or equal to 2 mm.

31. A device according to claim 1, the applicator head including a composition outlet orifice having a greatest dimension that is less than or equal to 5 mm.

32. A device according to claim 1, the cavity having an oval outline.

33. A device according to claim 1, the applicator element being molded from at least two materials.

34. A device according to claim 1, the reservoir containing a composition for making-up the lips.

35. A device according to claim 1, the applicator head including a flexible portion, and the reservoir being configured in such a manner that the flexibility of said flexible portion makes it possible to change the orientation of the cantilevered-out portion when said cantilevered-out portion is subjected to stress.

36. A device according to claim 35, said cantilevered-out portion being brought manually against a surface of the body to be made-up.

37. A device according to claim 35, the flexible portion being formed in the proximity of the reservoir, set back from a free distal end of the application face.

38. A device according to claim 1, the cavity presenting a diameter lying in the range 1 mm to 5 mm.

39. A device according to claim 1, the cavity being off-center relative to the application face.

40. A device according to claim 1, the application face presenting a pear-shaped outline.

41. A device according to claim 1, the applicator head being flocked, and the flocking being made with bristles of length that is greater than 1 mm, such that the ends of the flocking bristles define a plane that is distinct from a plane in which the cavity is defined.

42. A device according to claim 1, wherein the reservoir contains the composition to be dispensed, the composition being a paste or a gel, and having viscosity such that it does not flow by capillarity when the device is head down.

* * * * *